US009902049B2

(12) United States Patent
Douglass

(10) Patent No.: US 9,902,049 B2
(45) Date of Patent: Feb. 27, 2018

(54) COMBINATION WRENCH WITH A REVERSIBLE ROLLER CLUTCH

(71) Applicant: Earl Stuart Douglass, Auburn, CA (US)

(72) Inventor: Earl Stuart Douglass, Auburn, CA (US)

(73) Assignee: ROLLER CLUTCH TOOLS LLC, Auburn, CA (US)

( * ) Notice: Subject to any disclaimer, the term of this patent is extended or adjusted under 35 U.S.C. 154(b) by 192 days.

(21) Appl. No.: 14/937,530

(22) Filed: Nov. 10, 2015

(65) Prior Publication Data

US 2016/0129562 A1 May 12, 2016

Related U.S. Application Data

(60) Provisional application No. 62/077,545, filed on Nov. 10, 2014.

(51) Int. Cl.
*B25B 13/46* (2006.01)
*B25B 13/48* (2006.01)

(52) U.S. Cl.
CPC ..... *B25B 13/462* (2013.01); *B25B 13/481* (2013.01)

(58) Field of Classification Search
CPC ..... B25B 13/462; B25B 13/481
USPC ..... 81/59.1
See application file for complete search history.

(56) References Cited

U.S. PATENT DOCUMENTS 1,033,049 A * 7/1912 Chase et al. ..... B25B 13/462 192/45.017
1,609,086 A * 11/1926 Hurschman ..... B25B 13/462 81/179
5,848,561 A * 12/1998 Hsieh ..... B25B 23/0035 81/125
6,253,646 B1 * 7/2001 Chang ..... B25B 13/462 192/44
2006/0016295 A1 * 1/2006 Hsien ..... B25B 13/462 81/59.1
2010/0176562 A1 * 7/2010 Linzell ..... B23B 31/1612 279/123

* cited by examiner

*Primary Examiner* — Hadi Shakeri

(57) ABSTRACT

A force transfer wrench apparatus includes a housing assembly and a handle attached to the housing assembly. The housing assembly includes a housing, a spindle, and wedging element. The spindle is disposed within the housing. The housing includes an annular outer race. The spindle includes an opening at a center of the spindle and at least one protrusion around an outer circumference of the spindle. The protrusion forms a ramp including a ramp surface. The ramp surface slopes from the outer circumference of the spindle to a larger outer circumference of the spindle. The wedging element is disposed between the spindle and the outer race. The wedging element is a cylinder comprising an outer surface. The wedging element is disposed between the spindle and the outer race such that the outer surface of the wedging element contacts the ramp surface.

19 Claims, 11 Drawing Sheets

COMBINATION WRENCH WITH A REVERSIBLE ROLLER CLUTCH

CROSS-REFERENCE TO RELATED APPLICATIONS

This application claims the benefit of U.S. Provisional Patent Application Ser. No. 62/077,545 filed on Nov. 10, 2014, and entitled "Combination Wrench with a Reversible Roller Clutch," the contents of which are hereby incorporated by reference herein.

BACKGROUND

Combination wrenches are used to tighten or loosen fasteners. The industry standard for this type of tool is a single handle with a box-end shape on one end of the handle and an open-end shape on the opposite side of the handle. The original box-end shape was a solid unit with no moving parts. Such a design required the operator to lift, rotate and reset the wrench for each stroke of the tool. This is a time consuming process and the solid unit was replaced with a ratchet gear system that utilizes a driving gear with a spring loaded pawl. The pawl enables the operator to apply toque in one direction and to slip in the opposite direction. The reciprocal motion of the handle allows the wrench to maintain continuous contact with the fastener during the tightening or loosening process. The ability to maintain constant contact with the fastener is a major advantage over a traditional wrench because labor is significantly reduced.

The ratchet mechanism has drawbacks including friction between the pawl and the driving gear. Both have a set of teeth which engage and lock during the torque stroke. Additionally, the pawl teeth rub against the driving gear during the slip or back throw process. Such rubbing action creates friction and deteriorates the efficiency of the wrench. Over time the teeth can wear down and will require replacement. In addition, ratcheting mechanisms are indexed and require a large back throw between handle swings, which creates a problem with there is insufficient room for the handle to operate.

SUMMARY

Embodiments of a force transfer wrench apparatus are described. In one embodiment, a force transfer mechanism includes a housing assembly and a handle attached to the housing assembly. The housing assembly includes a housing, a spindle, and wedging element. The spindle is disposed within the housing. The housing includes an outer race. The outer race is annular. The spindle includes an opening at a center of the spindle and at least one protrusion around an outer circumference of the spindle. The protrusion forms a ramp including a ramp surface. The ramp surface slopes from the outer circumference of the spindle to a larger outer circumference of the spindle. The wedging element is disposed between the spindle and the outer race. The wedging element is a cylinder comprising an outer surface. The wedging element is disposed between the spindle and the outer race such that the outer surface of the wedging element contacts the ramp surface. Other embodiments of a force transfer wrench apparatus are described.

Other aspects and advantages of embodiments of the present invention will become apparent from the following detailed description, taken in conjunction with the accompanying drawings illustrated by way of example of the principles of the invention.

Figure 1:
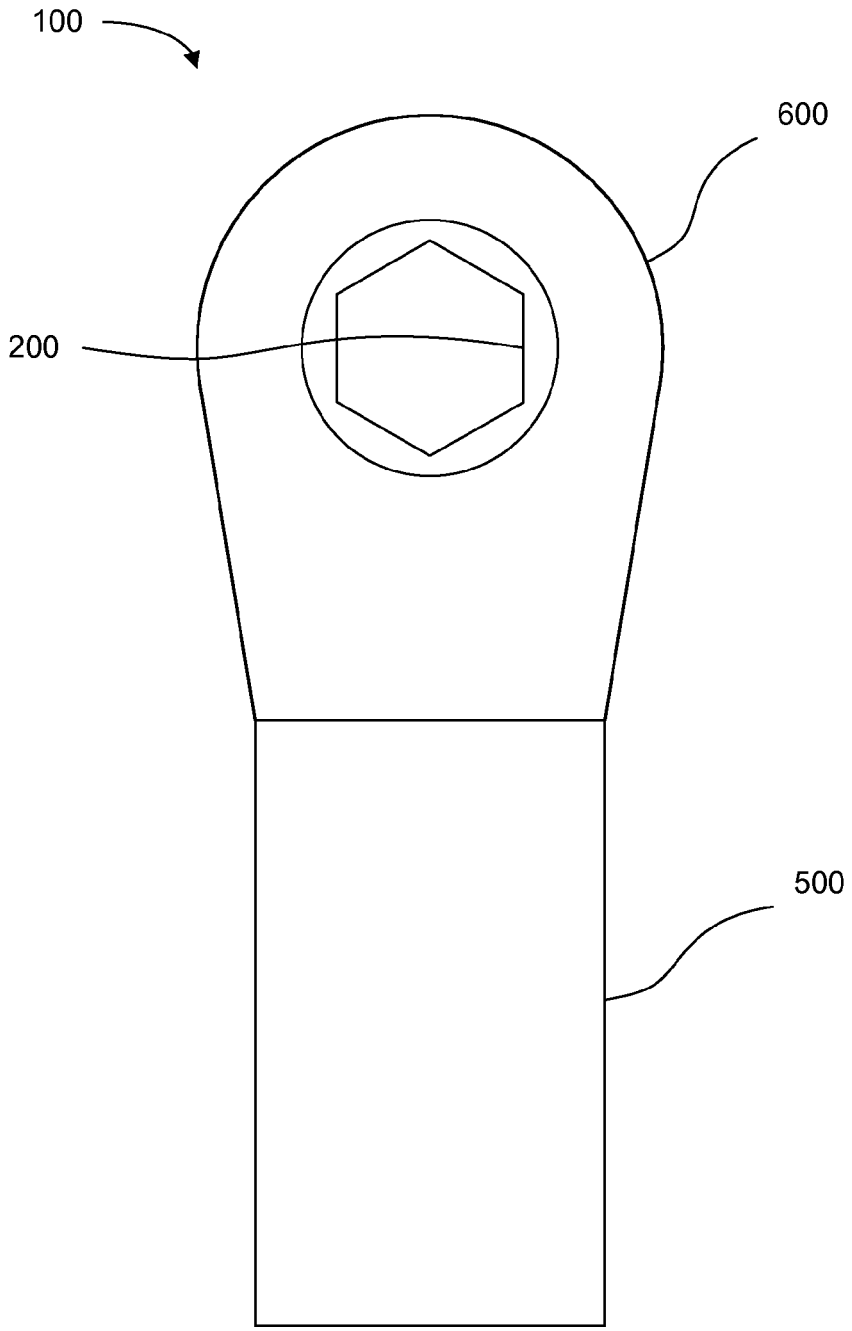
FIG. 1 depicts an embodiment of a force transfer mechanism or box wrench with a reversible roller clutch.

It will be appreciated that the drawings are illustrative and not limiting of the scope of the invention which is defined by the appended claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity. Similarly, not every embodiment need accomplish all advantages of the present invention.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the spirit and scope of the invention as defined by the appended claims.

Throughout the description, similar reference numbers may be used to identify similar elements.

DETAILED DESCRIPTION

In the following description, specific details of various embodiments are provided. However, some embodiments may be practiced with less than all of these specific details. In other instances, certain methods, procedures, components, structures, and/or functions are described in no more detail than to enable the various embodiments of the invention, for the sake of brevity and clarity.

It will be readily understood that the components of the embodiments as generally described herein and illustrated could be arranged and designed in a wide variety of different configurations. Thus, the following description of various embodiments, and as represented in the figures, is not intended to limit the scope of the present disclosure, but is merely representative of various embodiments.

The present invention may be embodied in other specific forms without departing from its spirit or essential characteristics. The described embodiments are to be considered in all respects only as illustrative and not restrictive. All changes which come within the meaning and range of equivalency of the description and claims are to be embraced within their scope.

Reference throughout to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference to "one embodiment," "an embodiment," or similar language means that a particular feature, structure, or characteristic described in connection with the indicated embodiment is included in at least one embodiment of the present invention. Thus, the phrases "in one embodiment," "in an embodiment," and similar language throughout this specification may, but do not necessarily, all refer to the same embodiment.

While many embodiments are described herein, at least some of the described embodiments allow for a box wrench that does not require a user to lift, rotate, and reset the wrench for each stroke while also eliminating or reducing friction. Embodiments allow for less deterioration of parts of the clutch. Some embodiments allow for the resumption of a torque at any angle, which is critical in tight compartment applications. Some embodiments allow for a wrench that is not susceptible to the degradations of friction or shear force. Additionally, some embodiments allow a wrench to function with zero back throw. Some embodiments allow for a wrench that is stronger, safer, and easier to operate.

FIG. 1 depicts an embodiment of a roller clutch wrench apparatus 100. The illustrated embodiment depicts a hexagonal box wrench with a reversible roller clutch. Although the apparatus 100 is shown and described with certain components and functionality, other embodiments of the apparatus 100 may include fewer or more components to implement less or more functionality.

The illustrated embodiment includes a spindle 200 housed within a housing 500 and partially covered by a cap 600. In the illustrated embodiment the housing 500 includes a handle. In some embodiments, the handle may be detachable from the housing. In such embodiments, a single handle could be used and attached to various spindle housing sizes. In such embodiments, a user may have multiple housings 500 with various size spindles 200, and various shaped spindles. The illustrated embodiment depicts a hexagonal spindle. However, the spindle 200 may be manufactured to mate with fasteners and bolts of various shapes and sizes. The features, structure, characteristics, and functions of the various components are described more fully in the figures and description that follow.

Figure 2A:
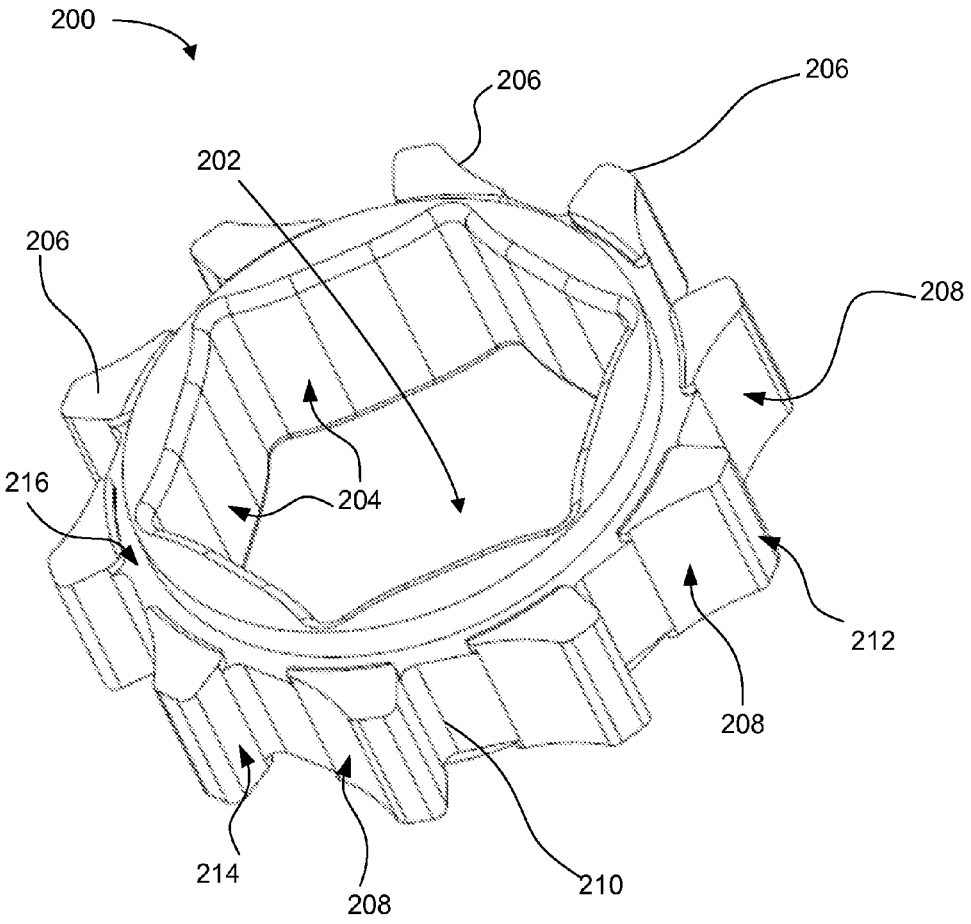
FIG. 2A depicts a perspective view of an embodiment of a spindle of a force transfer mechanism.
Figure 2B:
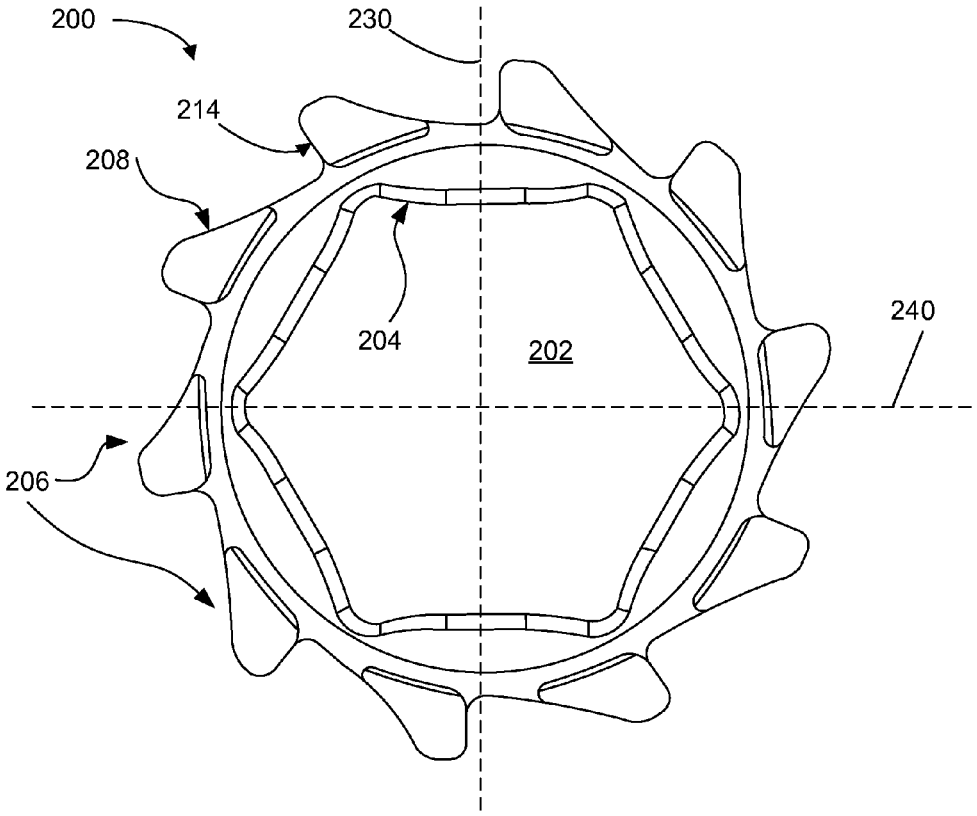
FIG. 2B depicts a top view of an embodiment of a spindle of a force transfer mechanism.
Figure 2C:
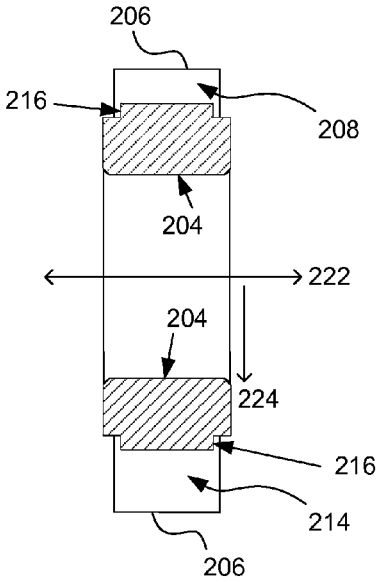
FIG. 2C depicts a cross-sectional side view of a cut-away at the vertical line of the spindle of FIG. 2B.
Figure 2D:
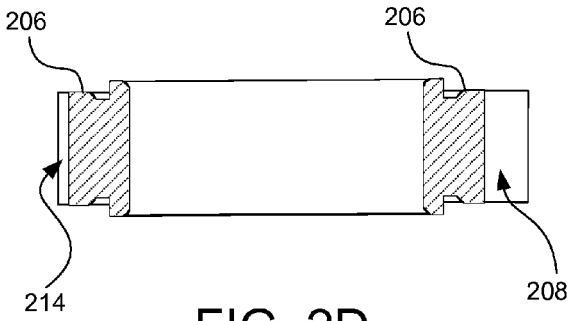
FIG. 2D depicts a cross-sectional side view of a cut-away at the horizontal line of the spindle of FIG. 2B.
Figure 2E:
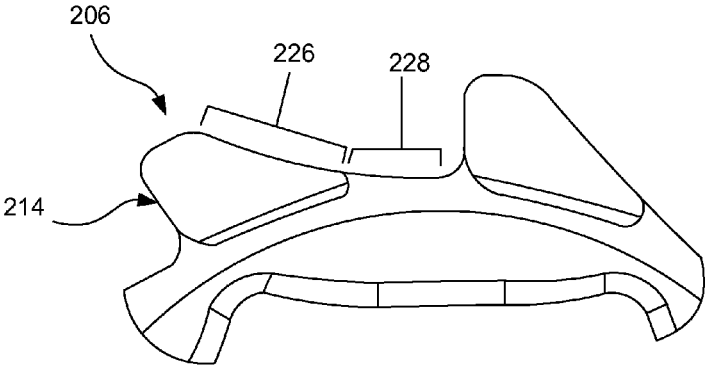
FIG. 2E depicts an embodiment of a cut-away view of a spindle of a force transfer mechanism as well as a wedging element.

FIG. 2A depicts a perspective view of an embodiment of a spindle 200 of a force transfer wrench apparatus 100. Although the spindle 200 is shown and described with certain components and functionality, other embodiments of the spindle 200 may include fewer or more components to implement less or more functionality. FIG. 2B depicts a top view of an embodiment of a spindle of a force transfer mechanism. FIG. 2C depicts a cross-sectional side view of a cut-away of the spindle. FIG. 2D depicts another cross-sectional side view of a cut-away of the spindle. FIG. 2E depicts an embodiment of a cut-away view of a spindle as well as a wedging element which is described more fully in FIGS. 4A-4C.

In some embodiments, the spindle 200 is made of a single material. In some embodiment, the spindle 200 is rigid. The illustrated embodiment includes an opening 202 through the center of the spindle 200. In some embodiments, the opening is offset from the center of the spindle 200. The opening 202 may comprise of various shapes and sizes. While the illustrated embodiment depicts a hexagonal opening 202, the spindle 200 may be manufactured with an opening to fit the size and shape of various fasteners and bolts. The opening 202 may be of shapes including but not limited to 12 sided, 6 sided, and other numbers of sides. Additionally, the opening 202 may be configured to interface with fasteners that are flat faced, convex faced, concave faced, or other various shapes. The illustrated opening 202 includes concave faces 204.

In some embodiments, the spindle 200 includes a series of protrusions 206 that extend radially out around an outer circumference of the spindle 200. In some embodiments, the protrusions 206 are evenly spaced around the outer circumference of the spindle 200. The illustrated embodiment depicts ten protrusions 206 evenly spaced around the outer circumference of the spindle 200. The spindle 200 may include various numbers of protrusions fewer or more than what is depicted in FIG. 2A. In some embodiments, the protrusions may align with the opening faces 204 (e.g., 12 protrusions aligned with the opening faces of a 12-sided wrench).

In some embodiments, the protrusions 206 form a ramp including a ramp surface 208 that is configured to be a sloped shape that slopes from an outer circumference 210 to a greater outer circumference 212. In some embodiments, the ramp surface 208 is concave to better interface with the wedging elements and provide more contact surface area for the wedging elements to contact. By maximizing the contact surface, brinelling and slipping are eliminated when the spindle is in a torqued condition (a torqued condition is illustrated and described more fully in conjunction with FIG.

3A). Additionally, handle back swing is minimized in the non-torqued condition (a non-torqued condition is illustrated and described more fully in conjunction with FIG. 3B). In the illustrated embodiment, the protrusions 206, in addition to extending radially from the center of the spindle opening 202, extend slightly in the axial direction from the spindle face 216.

FIG. 2B depicts a top view of an embodiment of a spindle 200 of a force transfer wrench apparatus 100. The illustrated view depicts the protrusions 206 and depicts the ramp surface 208 as well as the back surface 214 of the protrusions 206. As depicted, the ramp surface is not flat but slightly concave to better interface with the wedging elements and increasing the contact surface between the wedging elements and the ramp surface 208.

In the illustrated embodiment, the axial direction extends into and out of the page and the radial direction extends from the intersection of vertical line 230 and horizontal line 240 outward.

FIG. 2C depicts a cross-sectional side view of a cut-away of the spindle of FIG. 2B at vertical line 230. The illustrated cross-sectional view depicts how the protrusion 206 extends in the axial direction from the spindle face 216. The axial direction is shown by line 222, while the radial direction is shown by line 224. In addition, protrusions 206 are depicted including ramp surface 208 and back surface 214.

FIG. 2D depicts a cross-sectional side view of a cut-away of the spindle of FIG. 2B at the horizontal line 240. In addition, protrusions 206 are depicted including ramp surface 208 and back surface 214.

FIG. 2E depicts an embodiment of a cut-away view of a spindle 200 of a force transfer wrench apparatus. The illustrated embodiment depicts protrusions 206 and ramp surface 208 and back surface 214. In some embodiments, the ramp surface comprises a curved portion 226 and a flat portion 228. As is described herein, the curved portion is slightly concave to better interface with the wedging elements and increases the contact surface between the wedging elements and the ramp surface 208.

Figure 3A:
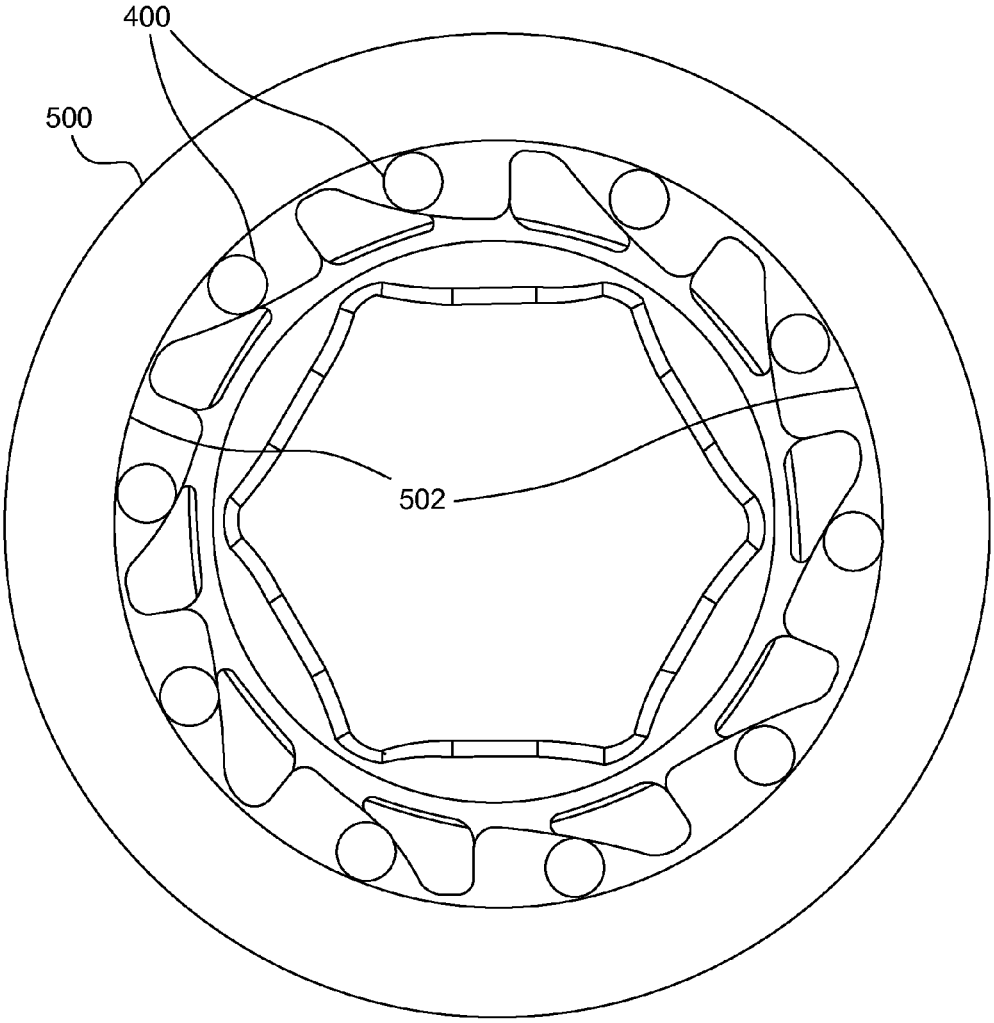
FIG. 3A depicts an embodiment of a spindle and wedging elements disposed within a housing, the wedging elements disposed between the housing and the spindle.

FIG. 3A depicts an embodiment of a spindle 200 and wedging elements 400 disposed within a housing 500, the wedging elements 400 disposed between the housing 500 and the spindle 200. In the illustrated embodiment, the spindle 200 is shown in a torqued position as the spindle 200 is restricted from rotating in a clockwise motion relative to the housing 500. The wedging elements 400 wedge between ramp surface of the protrusions and the outer race 502 of the housing 500.

Figure 3B:
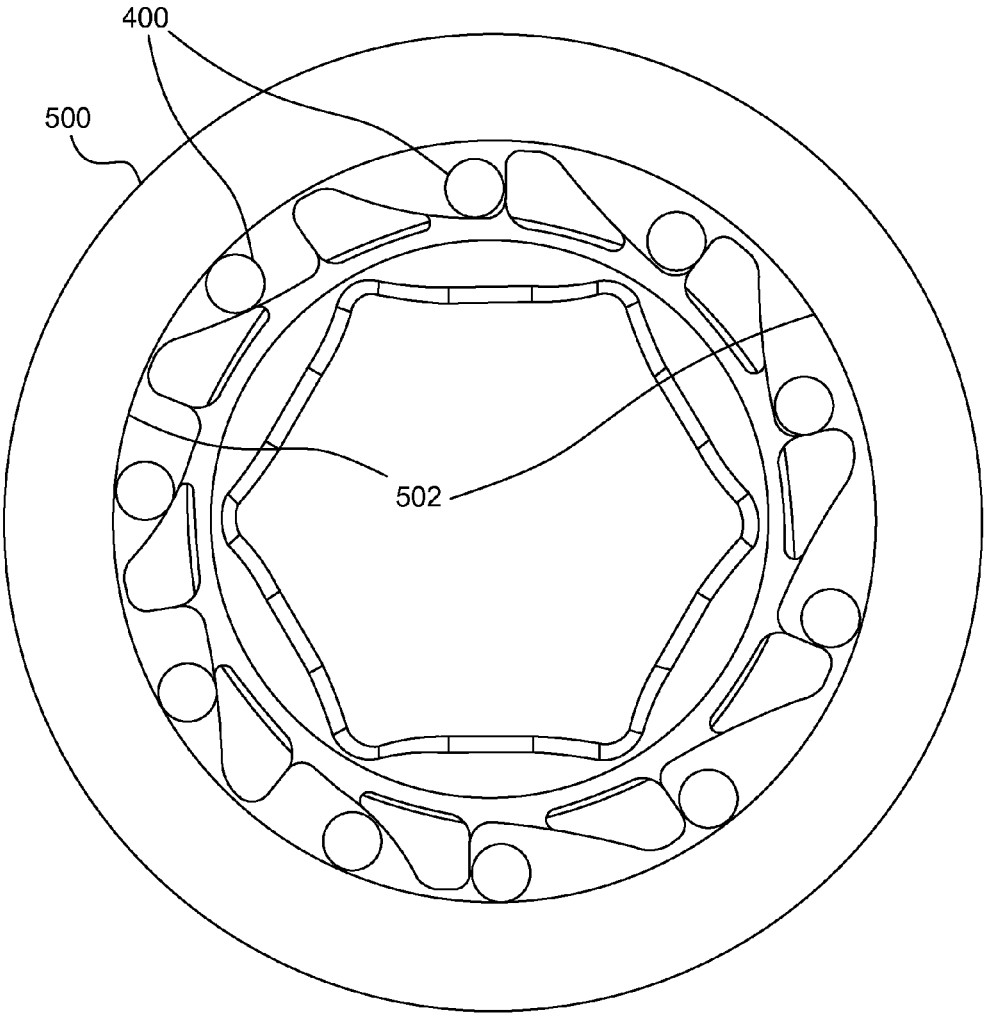
FIG. 3B depicts an embodiment of a spindle and wedging elements disposed within a housing, the wedging elements disposed between the housing and the spindle.

FIG. 3B depicts an embodiment of a spindle 200 and wedging elements 400 disposed within a housing 500, the wedging elements 400 disposed between the housing 500 and the spindle 200. In the illustrated embodiment, the spindle 200 is shown in a non-torqued position as the spindle 200 freely rotates in a counter-clockwise motion relative to the housing 500. The wedging elements 400 are not compressed in between the outer race 502 of the housing 500 and the ramp surfaces of the protrusions 206. The ramp surfaces 208 are a sloped shape such that when the spindle 200 rotates counter clockwise, the wedging elements are free in the cavity between the ramp surfaces 208 and the outer race 502. The cavity increases in cross-sectional area as wedging elements come closer to the back surface 214 of the protrusions 206. With such a roller clutch, the spindle 200, shown in FIGS. 3A and 3B restrict motion of the spindle 200 in a clockwise direction but allow for free motion in a counter-clockwise direction.

Figure 4A:
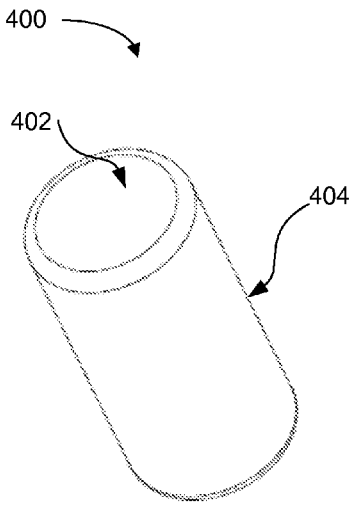
FIG. 4A depicts a perspective view of an embodiment of a wedging element.
Figure 4B:
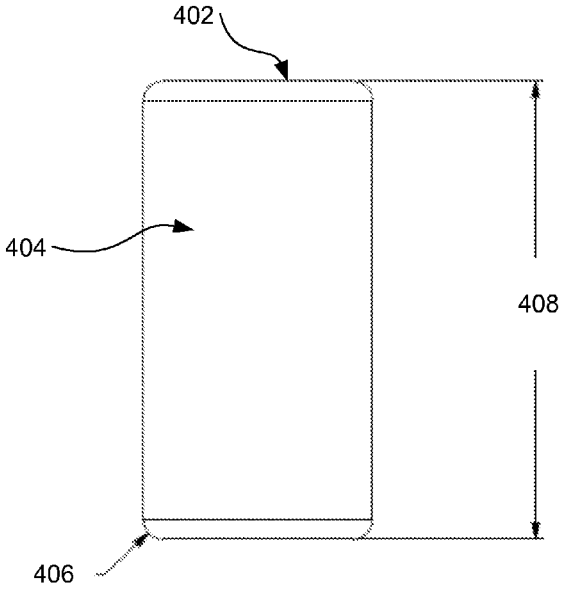
FIG. 4B depicts side view of the wedging element of FIG. 4A
Figure 4C:
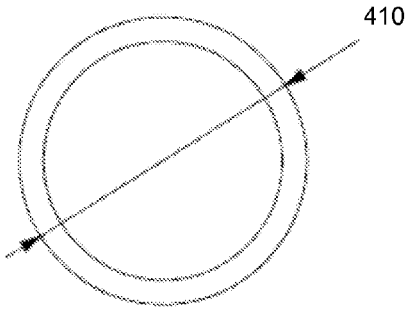
FIG. 4C depicts a top view of the wedging element of FIG. 4A.

FIG. 4A depicts a perspective view of an embodiment of a wedging element 400. FIG. 4B depicts side view of the wedging element 400 of FIG. 4A. FIG. 4C depicts a top view of the wedging element 400 of FIG. 4A. Although the wedging element 400 is shown and described with certain components and functionality, other embodiments of the wedging element 400 may include fewer or more components to implement less or more functionality.

The illustrated embodiment of the wedging element 400 is primarily cylindrical in shape. FIGS. 3A and 3B show the top surface 402 of the wedging elements 400. In some embodiments, the wedging elements 400 are rounded 406 or chamfered on the edges of the primarily cylindrical shape. The wedging elements may be of various shapes such that they will wedge and compress between the spindle and the outer race on a particular rotation of the spindle and will freely allow movement in an opposite rotation. In some embodiments, the wedging elements include a height 408 approximately the size of the cavity between the housing cavity back (described in more detail in conjunction with FIGS. 5A-5C) and the cap (described in more detail in conjunction with FIGS. 6A-6F). The side surface 404 of the wedging element 400 contact the ramp surface 208 and the outer race 502 when the wedging element 400 is placed within the force transfer wrench apparatus. In some embodiments, the wedging element 400 includes a diameter 410 optimized to fit within the cavity between the spindle 200 and the outer race 502.

Figure 4D:
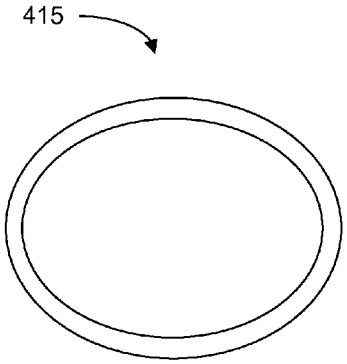
FIG. 4D depicts a top view of another embodiment of a wedging element in the shape of an elliptical cylinder.

The wedging elements 400 are not restricted to a circular cylinder as depicted in FIGS. 4A-4C. FIG. 4D depicts a top view of another embodiment of a wedging element in the shape of an elliptical cylinder 415. The wedging element may be manufactured to another shape to better conform to the concavity of the ramp surface. The wedging element may be (but is not limited to) a circular cylinder, an elliptical cylinder, a curvilinear cylinder, a polyhedral prism, a combination of a curvilinear cylinder and a polyhedral prism. The shape of the wedging element can be designed to increase the contact surface between the wedging element and the ramp surface as well as the contact surface between the wedging element and the outer race. For example, an elliptical cylinder may have an outer surface that more closely mates to the concave ramp surface.

Figure 5A:
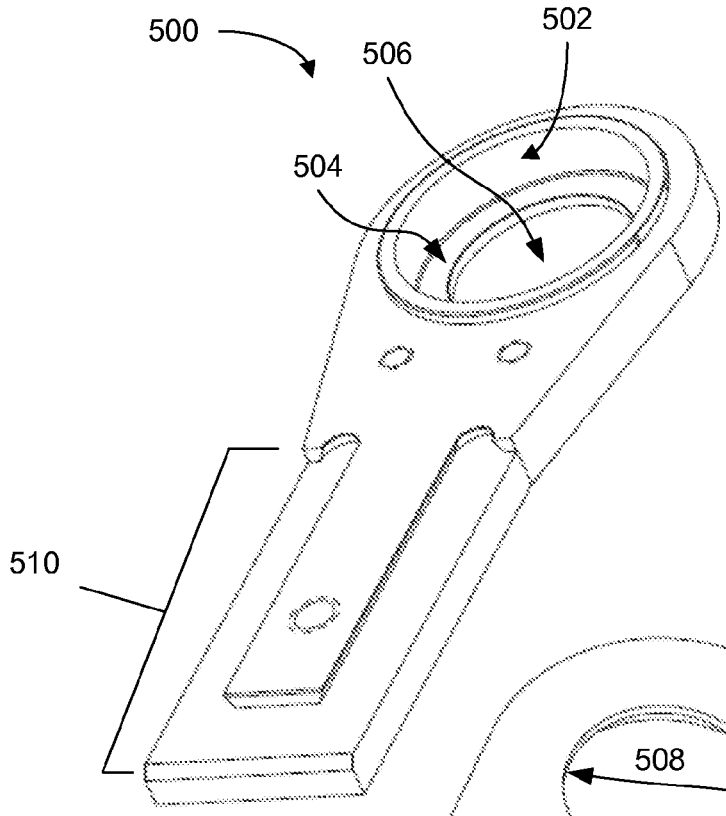
FIG. 5A depicts a perspective view of an embodiment of a housing with an outer race.

FIG. 5A depicts a perspective view of an embodiment of a housing 500 with an outer race 502. The illustrated embodiment includes a cavity which holds the spindle 200 and the wedging elements 400. The housing 500 includes a cavity back 504 upon which the spindle 200 and the wedging elements 400 would rest. The housing 500 includes an opening 506. The opening 506 has a diameter (shown in FIG. 5B) greater that the largest cross dimension of the spindle opening 202. After the spindle 200 and wedging elements 400 are set in the cavity of the housing 500, a cap 600 is secured or attached to the housing 500 creating a cage for the spindle 200 and wedging elements 400 such that the spindle 200 and the wedging elements 400 are secured within the cage. The spindle opening 202 is accessible from the housing opening 506 and an opening in the cap 600. In some embodiments, the outer race 502 is circular in shape.

Figure 5B:
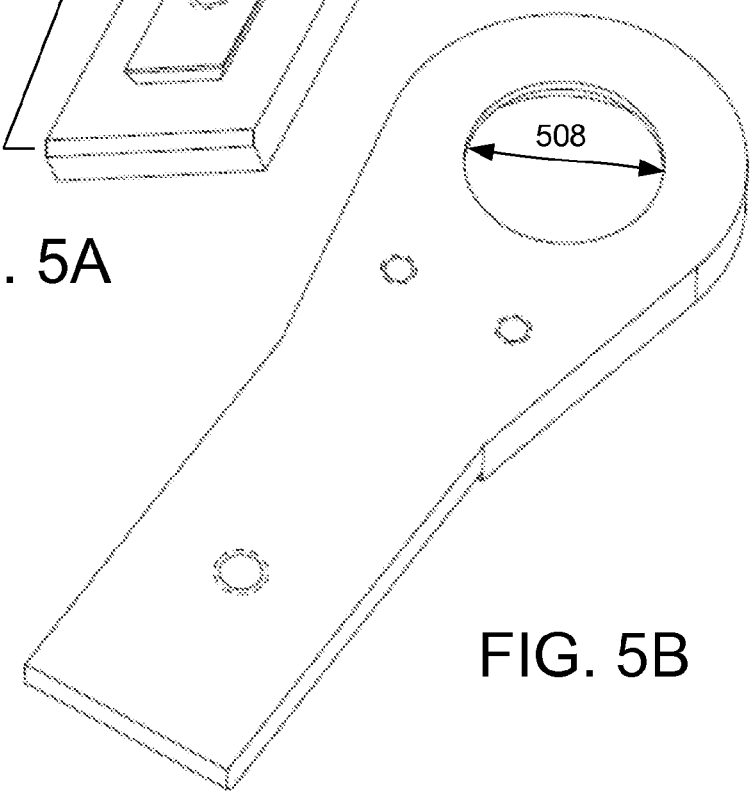
FIG. 5B depicts another perspective view of an embodiment of the housing of FIG. 5A.
Figure 5C:
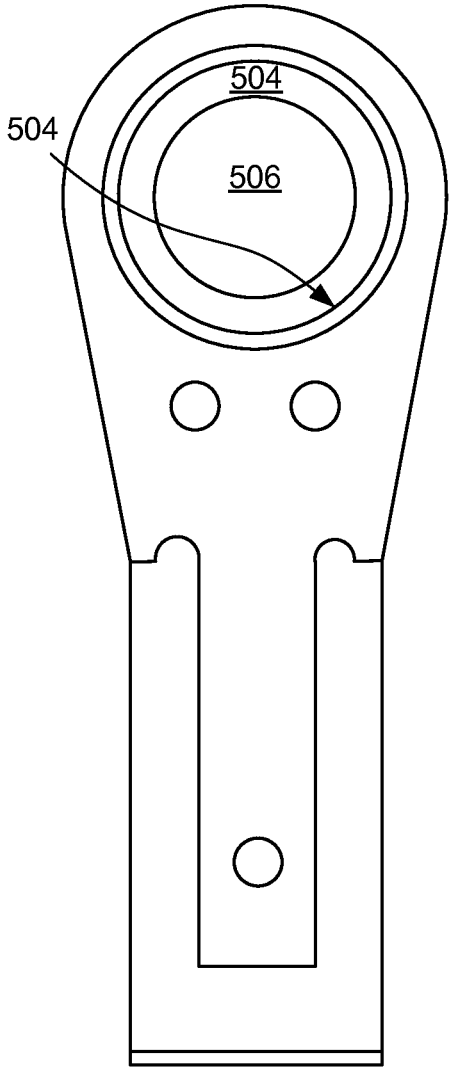
FIG. 5C depicts a top view of an embodiment of a housing with an outer race.

FIG. 5B depicts another perspective view of an embodiment of the housing 500 of FIG. 5A showing the back of the housing 500. The opening 506 has a diameter 508. The housing 500 also depicts various tapped holes that allow for the cap 600 to be secured to the housing 500. In the illustrated embodiment, the housing 500 includes a handle portion 510. In some embodiment, the handle is separate from the housing 500 and can be attached to and detached from various housing assemblies (the housing, spindle, wedging elements, and cap) each with a uniquely sized or shaped spindle 200. In such an embodiment, a user would only need a single handle to go with a set of housing assemblies. FIG. 5C depicts a top view of an embodiment of a housing 500 with an outer race 502 and further depicting the opening 506 and cavity back 504.

Figure 6A:
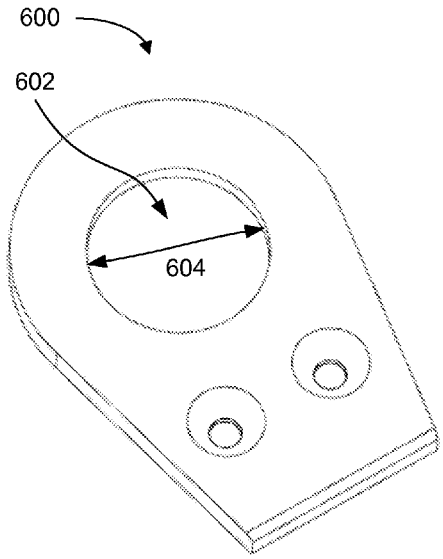
FIG. 6A depicts a perspective view of an embodiment of a cap.
Figure 6B:
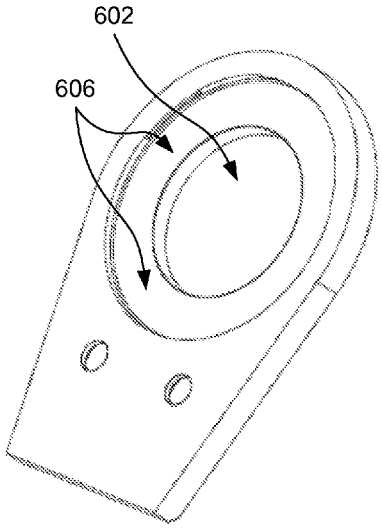
FIG. 6B depicts a perspective view of the bottom side of the cap of FIG. 6A.

FIG. 6A depicts a perspective view of an embodiment of a cap 600. FIG. 6A depicts the outer portion of the cap 600. FIG. 6B depicts a perspective view of the inner portion of the cap 600. The inner portion mates directly with the housing 500. The cap 600 includes a cap opening 602 with a diameter 604. The cap 600 also includes a cap cavity back 606. The cap cavity back 606 will cover the outer portion of the spindle 200 and the wedging elements 400 when cap is attached to the housing 500. The cap opening 602 will give access to the spindle opening as is shown in FIG. 1.

Figure 6C:
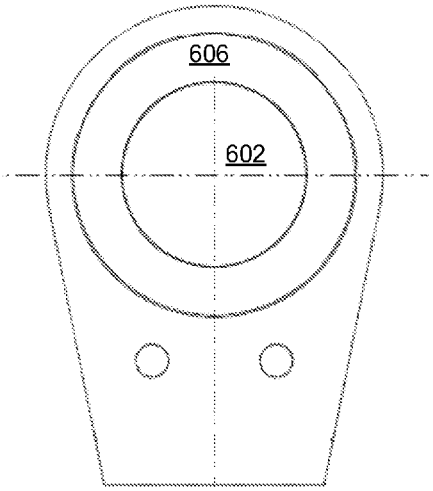
FIG. 6C depicts a bottom view of the cap of FIG. 6A.
Figure 6D:
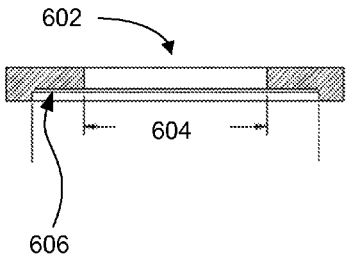
FIG. 6D depicts a side cutaway cross-sectional view of the cap at the horizontal line shown in FIG. 6C.
Figure 6E:
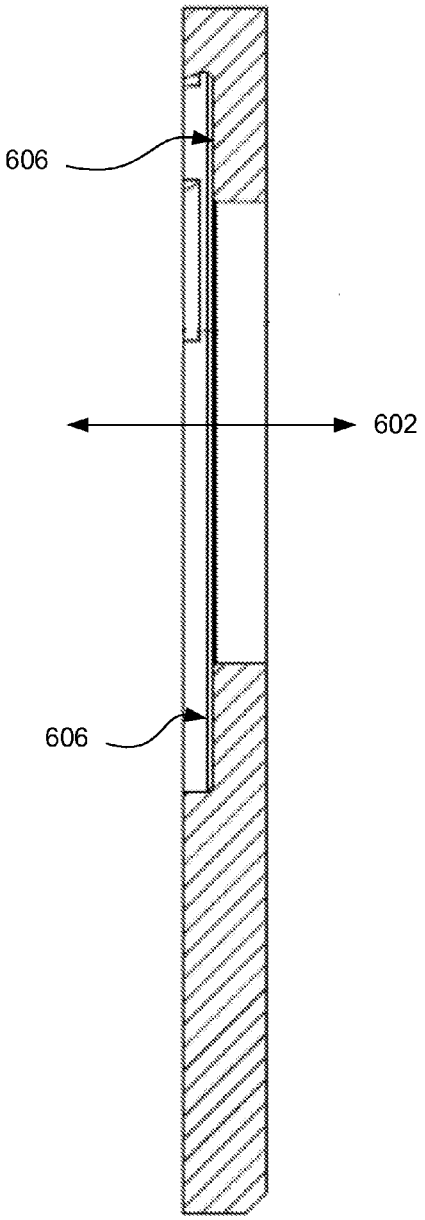
FIG. 6E depicts a side cutaway cross-sectional view of the cap at the vertical line shown in FIG. 6C.
Figure 6F:
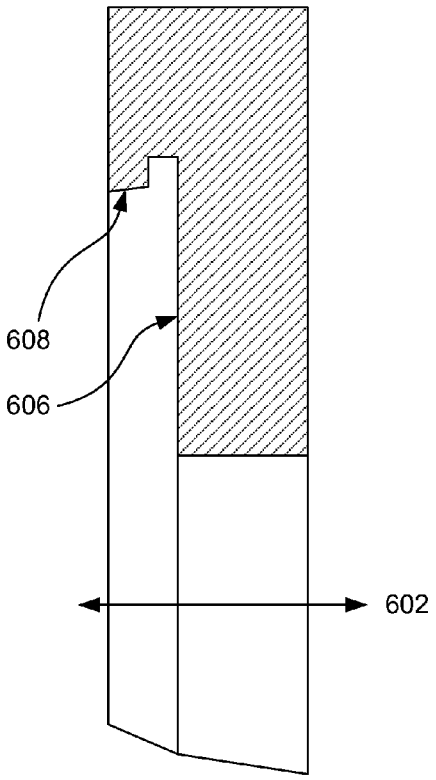
FIG. 6F depicts an enlarged view of an upper portion of the cap in FIG. 6E.

FIG. 6C depicts a bottom view of the cap 600 showing the inner portion of the cap and depicts the cap opening 602 and the cap cavity back 606. FIG. 6D depicts a side cutaway cross-sectional view of the cap at the horizontal line shown in FIG. 6C. FIG. 6E depicts a side cutaway cross-sectional view of the cap at the vertical line shown in FIG. 6C. FIG. 6F depicts an enlarged view of an upper portion of the cap in FIG. 6E. In some embodiments, the cap includes an outer race 608 that may interface with the spindle 200 and the wedging elements 400.

In the above description, specific details of various embodiments are provided. However, some embodiments may be practiced with less than all of these specific details. In other instances, certain methods, procedures, components, structures, and/or functions are described in no more detail than to enable the various embodiments of the invention, for the sake of brevity and clarity.

Although specific embodiments of the invention have been described and illustrated, the invention is not to be limited to the specific forms or arrangements of parts so described and illustrated. The scope of the invention is to be defined by the claims appended hereto and their equivalents.

Although various embodiments have been shown and described, the present disclosure is not so limited and will be understood to include all such modifications and variations are would be apparent to one skilled in the art.

What is claimed is:

1. A force transfer wrench apparatus comprising:

a housing assembly comprising:

a housing comprising an outer race, wherein the outer race is annular;

a spindle disposed within the housing, wherein the spindle comprises an opening at a center of the spindle, wherein the spindle comprises two or more protrusions around an outer circumference of the spindle, each protrusion comprising a ramp surface, a top surface and a back surface, wherein each protrusion forms a ramp comprising the ramp surface, wherein the ramp surface of a protrusion slopes from a back surface of an adjacent protrusion along the outer circumference of the spindle to a larger outer circumference of the spindle comprising the top surface of the protrusion, the back surface of a protrusion opposite the ramp surface, wherein the ramp surface comprises a curved portion and a flat portion, the flat portion extending from the back surface of an adjacent protrusion to the curved portion and the curved portion extending from the flat portion to the top surface, wherein the curved portion is concave;

a wedging element disposed between the spindle and the outer race, wherein the wedging element is a cylinder comprising an outer surface, wherein the wedging element is disposed between the spindle and the outer race such that the outer surface of the wedging element contacts the ramp surface and the outer race; and a handle attached to the housing assembly.

2. The force transfer wrench apparatus of claim 1, wherein the spindle comprises a series of protrusions around an outer circumference of the spindle extending radially outward from the center of the spindle.

3. The force transfer wrench apparatus of claim 2, wherein the protrusions are identically shaped.

4. The force transfer wrench apparatus of claim 1, wherein the opening is one of a 6-sided opening, 12-sided opening, or a 4-sided opening.

5. The force transfer wrench apparatus of claim 1, wherein the opening extends through the spindle.

6. The force transfer wrench apparatus of claim 1, wherein the spindle is rigid.

7. The force transfer wrench apparatus of claim 1, wherein a contact surface between the wedging element and the ramp surface is maximized through concavity of the ramp surface.

8. The force transfer wrench apparatus of claim 1, wherein the handle is configured to attach and detach to the housing.

9. The force transfer wrench apparatus of claim 1, wherein the wedging element compresses between the ramp surface and the outer race when the apparatus is in a torqued condition, wherein the outer surface of the wedging element is one of circular, elliptical, or curvilinear.

10. The force transfer wrench apparatus of claim 1, wherein the concave shape of the curved portion of the ramp surface is oriented to contact a greater surface area of the wedging element than a contact area between the flat portion of the ramp surface and the wedging element.

11. A force transfer wrench apparatus comprising:

a spindle comprising a box wrench head disposed within housing cage, wherein the spindle comprises a series of protrusions extending radially outward around an outer circumference of the spindle, each protrusion comprising a ramp surface, a top surface and a back surface, wherein each protrusion forms a ramp comprising a ramp surface, wherein the ramp surface of a protrusion slopes from a back surface of an adjacent protrusion along the outer surface of the spindle to a larger outer surface of the protrusion, the back surface of a protrusion opposite the ramp surface, wherein the ramp surface comprises a curved portion and a flat portion, the flat portion extending from the back surface of an adjacent protrusion to the curved portion and the curved portion extending from the flat portion to the top surface, wherein the curved portion is concave;

a housing comprising an outer race, wherein the outer race is annular;

a series of wedging elements disposed between the spindle and the outer race, wherein the wedging element compresses between the ramp surface and the outer race when the apparatus is in a torqued condition.

12. The force transfer wrench apparatus of claim 11, wherein the protrusions are identically shaped.

13. The force transfer wrench apparatus of claim 11, wherein an opening of the box wrench head is one of a 6-sided opening, 12-sided opening, or a 4-sided opening.

14. The force transfer wrench apparatus of claim 13, wherein the opening extends through the spindle.

15. The force transfer wrench apparatus of claim 11, wherein the wedging element is a circular cylinder.

16. The force transfer wrench apparatus of claim 11, wherein the ramp surface is concave, wherein a contact surface between the wedging element and the ramp surface is maximized when the apparatus is in a torqued condition.

17. The force transfer wrench apparatus of claim 11, further comprising a handle, wherein the handle is configured to attach and detach to the housing.

18. The force transfer wrench apparatus of claim 11, wherein the wedging elements compress between the ramp surface of the protrusions and the outer race when the apparatus is in a torqued condition.

19. The force transfer wrench apparatus of claim 11, wherein the wedging element comprises an outer surface, wherein the outer surface of the wedging element is one of circular, elliptical, or curvilinear.

* * * * *